US007131420B2

(12) United States Patent
Ito

(10) Patent No.: US 7,131,420 B2
(45) Date of Patent: Nov. 7, 2006

(54) POWER TRANSMISSION SYSTEM COVER FOR ENGINE

(75) Inventor: Yoshitada Ito, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/883,798

(22) Filed: Jul. 6, 2004

(65) Prior Publication Data

US 2005/0005893 A1 Jan. 13, 2005

(30) Foreign Application Priority Data

Jul. 7, 2003 (JP) ..... 2003-193149
Jul. 30, 2003 (JP) ..... 2003-203728

(51) Int. Cl.
*F01L 1/02* (2006.01)

(52) U.S. Cl. ..... 123/195 C; 123/195 A; 123/90.31

(58) Field of Classification Search ..... 123/195 C, 123/195 A, 198 C, 198 E
See application file for complete search history.

(56) References Cited

U.S. PATENT DOCUMENTS 4,938,185 A 7/1990 Doke
5,647,315 A * 7/1997 Saito ..... 123/196 AB
6,182,624 B1 * 2/2001 Ozeki ..... 123/90.33

FOREIGN PATENT DOCUMENTS

| | | |
|---|---|---|
| DE | 4211896 A1 | 10/1993 |
| DE | 19962095 A1 | 7/2000 |
| DE | 69525704 T | 8/2002 |
| JP | 3-11923 | 2/1991 |
| JP | 2505566 Y2 | 5/1996 |

* cited by examiner

*Primary Examiner*—Stephen K. Cronin
*Assistant Examiner*—Hyder Ali
(74) *Attorney, Agent, or Firm*—Birch, Stewart, Kolasch & Birch, LLP

(57) ABSTRACT

A power transmission system cover for an engine has a cover portion, formed of a single piece material and adapted to be attached to a sidewall of the engine, covering at least a part of a power transmission system which transmits a rotating force of a crankshaft to a camshaft. The cover portion is integrally provided with a passage forming portion defining a flow-passage in which a fluid element to be supplied to the engine flows, and an engine mount bracket located near the passage forming portion.

10 Claims, 5 Drawing Sheets

POWER TRANSMISSION SYSTEM COVER FOR ENGINE

CROSS-REFERENCE TO RELATED APPLICATIONS

This application incorporates by references the subject matter of Application No. 2003-193149 filed in Japan on Jul. 7, 2003 and Application No. 2003-203728 filed in Japan on Jul. 30, 2003, on which a priority claim is based under U.S.C § 119(a).

BACKGROUND OF THE INVENTION

1. Field of the Invention

This invention relates to a cover for a power transmission system that transmits a rotational force of a crankshaft of an engine to a camshaft.

2. Description of the Related Art

An engine has a bracket with which it is mounted in the body of an automobile. One such bracket is described in Jpn. UM Appln. KOKAI Publication No. 3-11923 (p. 5, 2–16; p. 6, 12–p. 7, 6; FIGS. 3 and 4). This bracket is fixed to a cylinder block with bolts. In attaching the bracket to the cylinder block, the bracket must be prevented from interfering with a belt for driving accessories, intake and exhaust pipes, a cooling water passage, etc., which are arranged around the cylinder block. To avoid the interference between the cooling water passage and the bracket, the passage is formed in the bracket.

In the engine constructed in this manner, however, the cooling water passage is passed through the bracket. In order to secure necessary strength for the bracket, therefore, the bracket must be large-sized. Since a joint (engaging hole, connector, etc.) for the connection of the cooling water passage requires machining, moreover, the shape of the bracket is intricate. Further, the cooling water passage is connected after the bracket is attached to the cylinder block, so that the flexibility of engine assembling means lowers. Thus, assembly work for the engine is complicated.

SUMMARY OF THE INVENTION

The present invention provides a power transmission system cover for engine, which is formed integrally with an engine mount bracket and has a sufficient stiffness for a basal part of the bracket.

A power transmission system cover for an engine according to this invention has a cover portion, a passage forming portion, and an engine mount bracket. The cover portion is located on a sidewall of an engine. The cover portion covers at least a part of a power transmission system which transmits a rotational force of a crankshaft to a camshaft. The passage forming portion projects from the cover portion and defines a flow-passage in which a fluid element to be supplied to the engine flows. The engine mount bracket is formed integrally with the cover portion and located near the passage forming portion.

BRIEF DESCRIPTION OF THE DRAWINGS

The nature of this invention, as well as other objects and advantages thereof, will be explained in the following with reference to the accompanying drawing, in which like reference characters designate the same or similar parts throughout the figures and wherein.

DETAILED DESCRIPTION OF THE INVENTION

Figure 1:
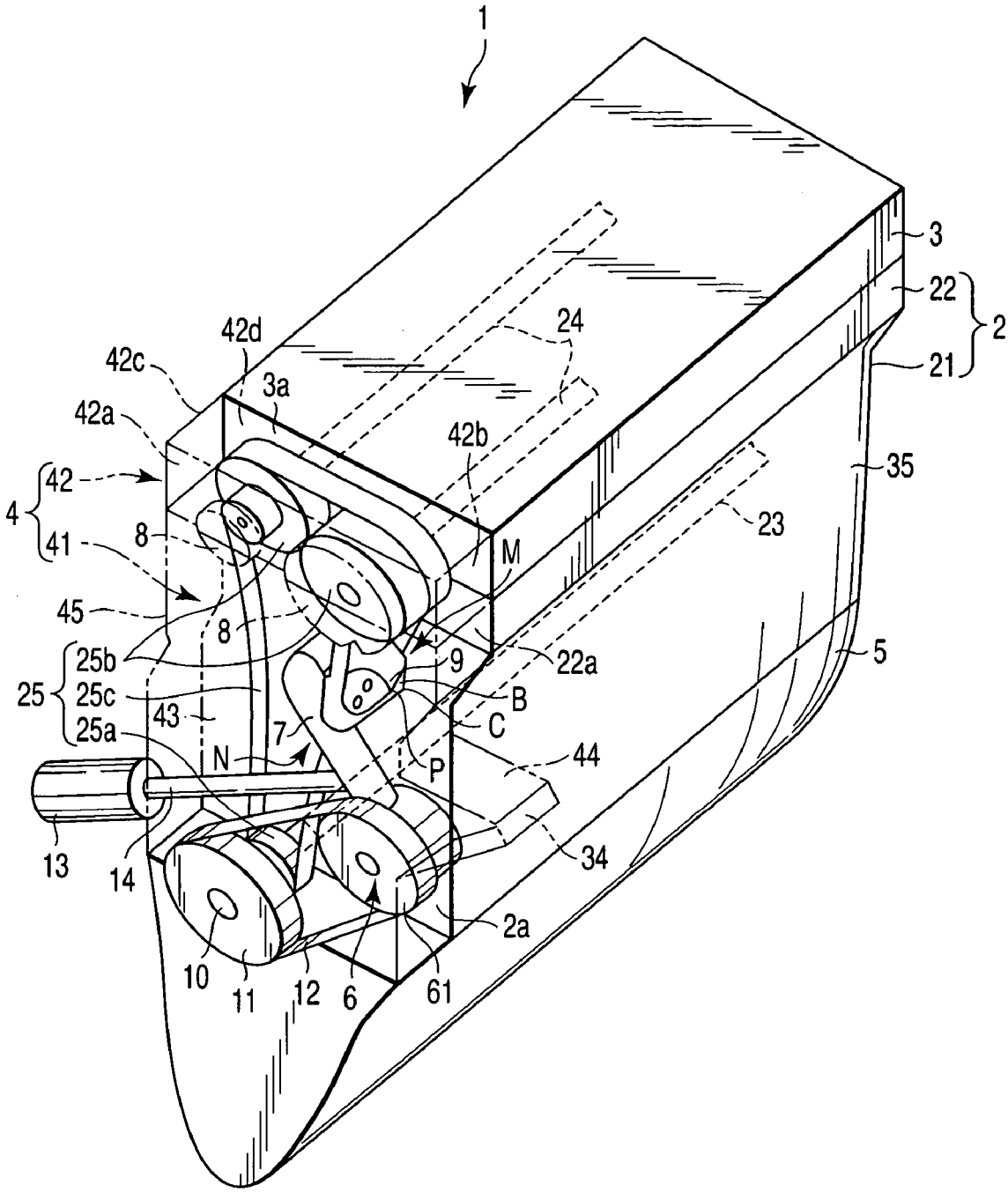
FIG. 1 is a perspective view showing a power transmission system cover for engine according to an embodiment of the invention.

A power transmission system cover for engine according to an embodiment of this invention will now be described with reference to FIGS. 1 to 7. FIG. 1 typically shows a reciprocating engine 1 of an automobile. The engine 1 has an engine block 2, a cylinder head cover 3, a chain case 4, and an oil pan 5.

Figure 2:
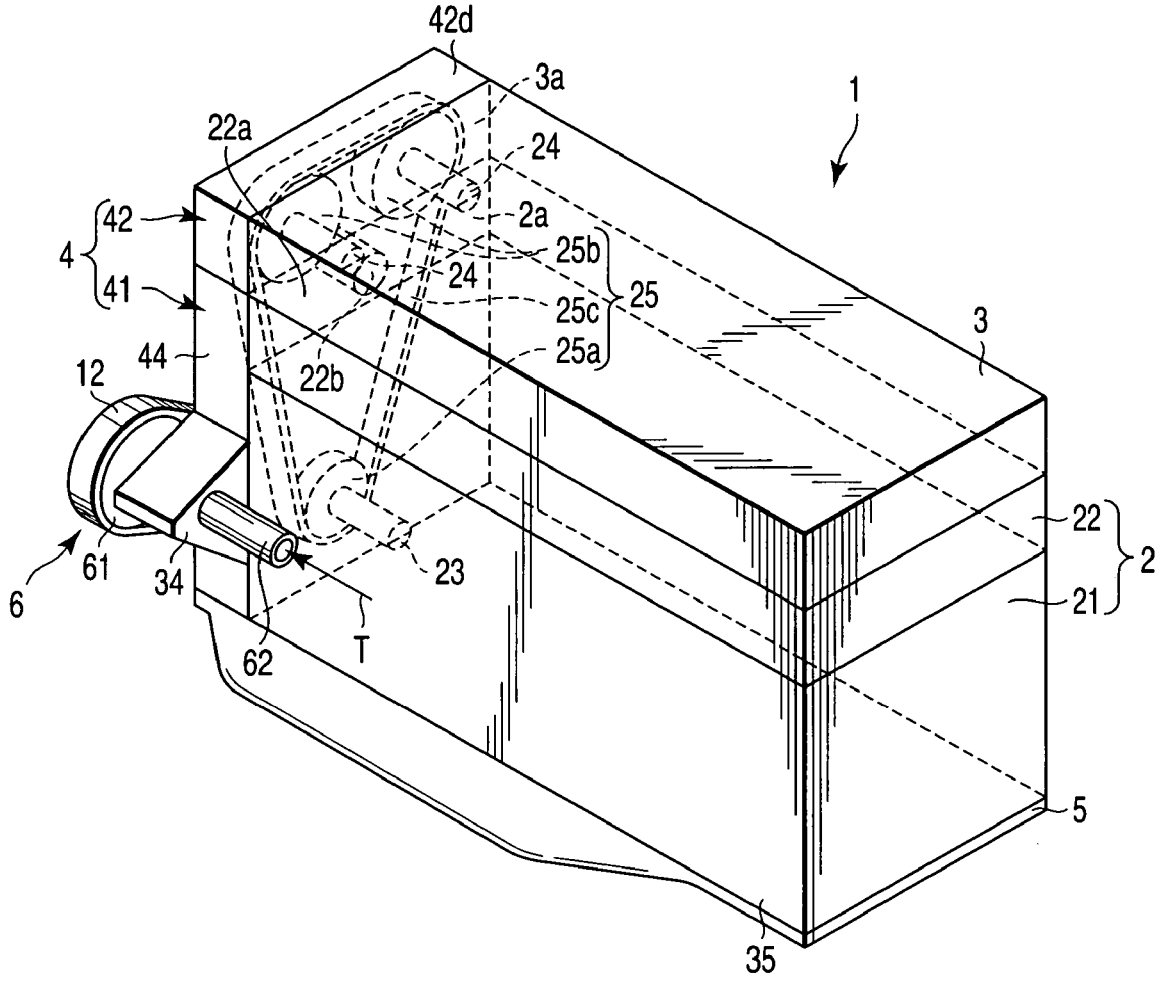
FIG. 2 is a perspective view of a lower chain case shown in FIG. 1, taken from another angle.
Figure 4:
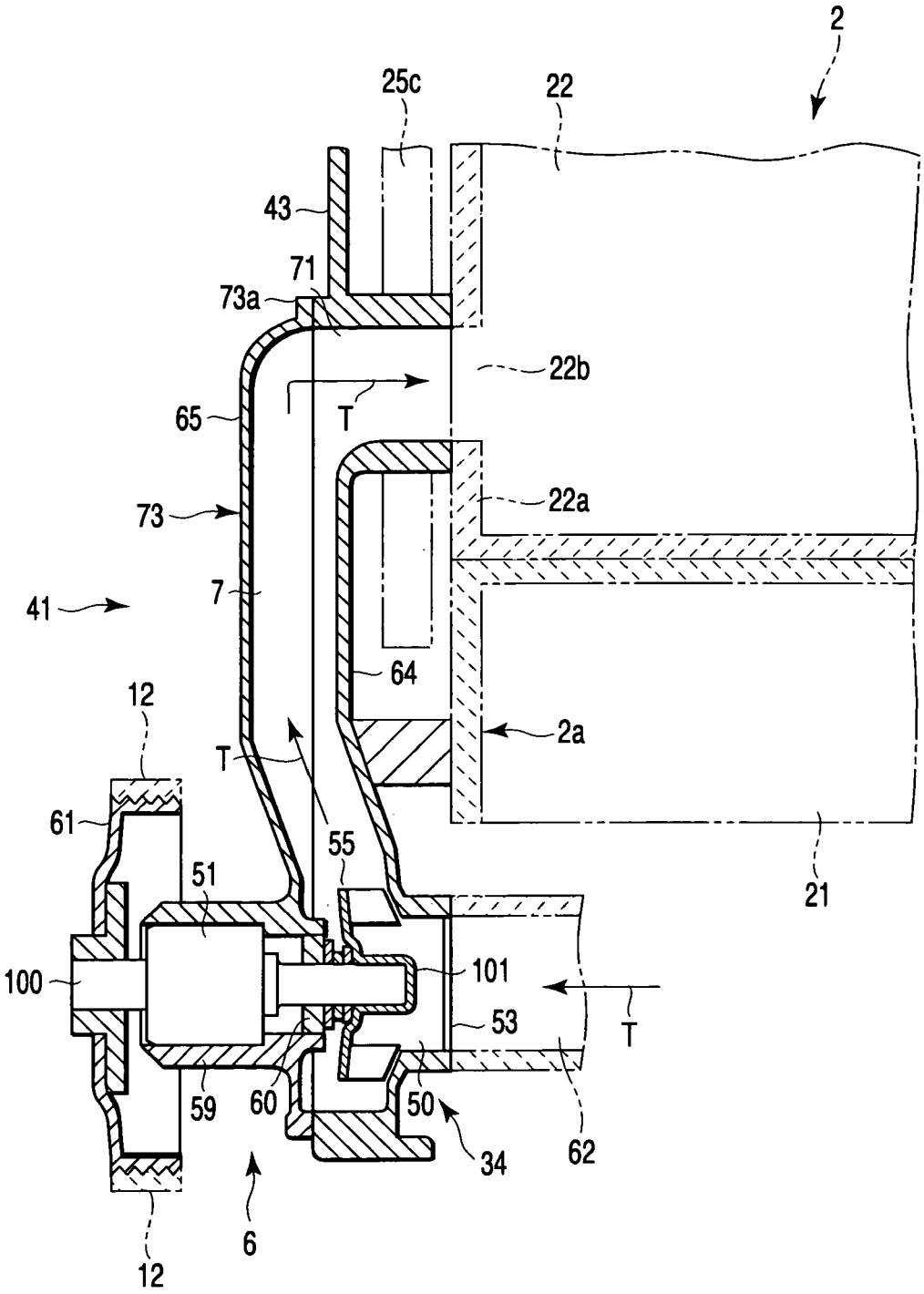
FIG. 4 is a sectional view of the lower chain case taken along line F4—F4 of FIG. 3.

The engine block 2 includes a cylinder block 21 and a cylinder head 22. The cylinder block 21 has a crankshaft 23. The cylinder head 22 is mounted on the cylinder block 21. The cylinder head 22 has a pair of camshafts 24. The camshafts 24 are located parallel to the crankshaft 23 on the intake and exhaust sides, individually. As shown in FIGS. 2 and 4, a cooling water inlet 22*b* through which cooling water flows into the cylinder head 22 opens at a front wall 22*a* of the head.

In the present embodiment, the rotation axis of the crankshaft 23 extends along a longitudinal (front-back) direction of the engine. The side on which the chain case 4 is attached to the engine block 2 is the front side, which defines the transverse (left-right) direction. The vertical direction is the direction in which the cylinder block 21 and the cylinder head 22 are put on each other. The upper side is the side on which the cylinder head 22 is situated with respect to the cylinder block 21.

On the other hand, the engine 1 is provided with a power transmission system 25. The power transmission system 25 links the crankshaft 23, which projects forward from the cylinder block 21, to the camshafts 24, which project forward from the cylinder head 22. The power transmission system 25 has a crankshaft timing sprocket 25*a*, camshaft timing sprockets 25*b*, and a timing chain 25*c*.

As shown in FIG. 1, the crankshaft timing sprocket 25*a* is fixedly fitted on the front end of the crankshaft 23. The camshaft timing sprockets 25*b* are fixedly fitted on the respective front ends of camshafts 24, individually. The timing chain 25*c* is passed around and between the timing sprockets 25*a* and 25*b*. The timing chain 25*c* transmits a turning force of the crankshaft 23 to the camshafts 24. The cylinder head cover 3 is mounted on the cylinder head 22.

The chain case 4 is attached to the respective front walls of the engine block 2 and the cylinder head cover 3 and covers the power transmission system 25. The chain case 4 is composed of a lower chain case 41 and an upper chain case 42, for example. The lower chain case 41 covers a front wall 2*a* of the engine block 2. The upper chain case 42 covers a front wall 3*a* of the cylinder head cover 3. The lower chain case 41 is an example of a power transmission system cover for engine according to the present invention.

The lower chain case 41 has a lower front wall 43, lower left-hand wall 44, lower right-hand wall 45, and a water pump mounting portion 34. The lower front wall 43 is located in the direction across the rotation axis of the crankshaft 23. The lower left- and right-hand walls 44 and 45 extend toward the engine block 2 from the left- and right-hand side edge portions, respectively, of the lower front wall 43 until they engage the front wall 2*a*. The lower front wall 43, lower left-hand wall 44, and lower right-hand wall 45 form a cover portion according to the present invention.

As shown in FIG. 2, the water pump mounting portion 34 projects outward from the lower left-hand wall 44 lest it overlap the cylinder block 21, along a line perpendicular to the axis of crankshaft 23.

Figure 3:
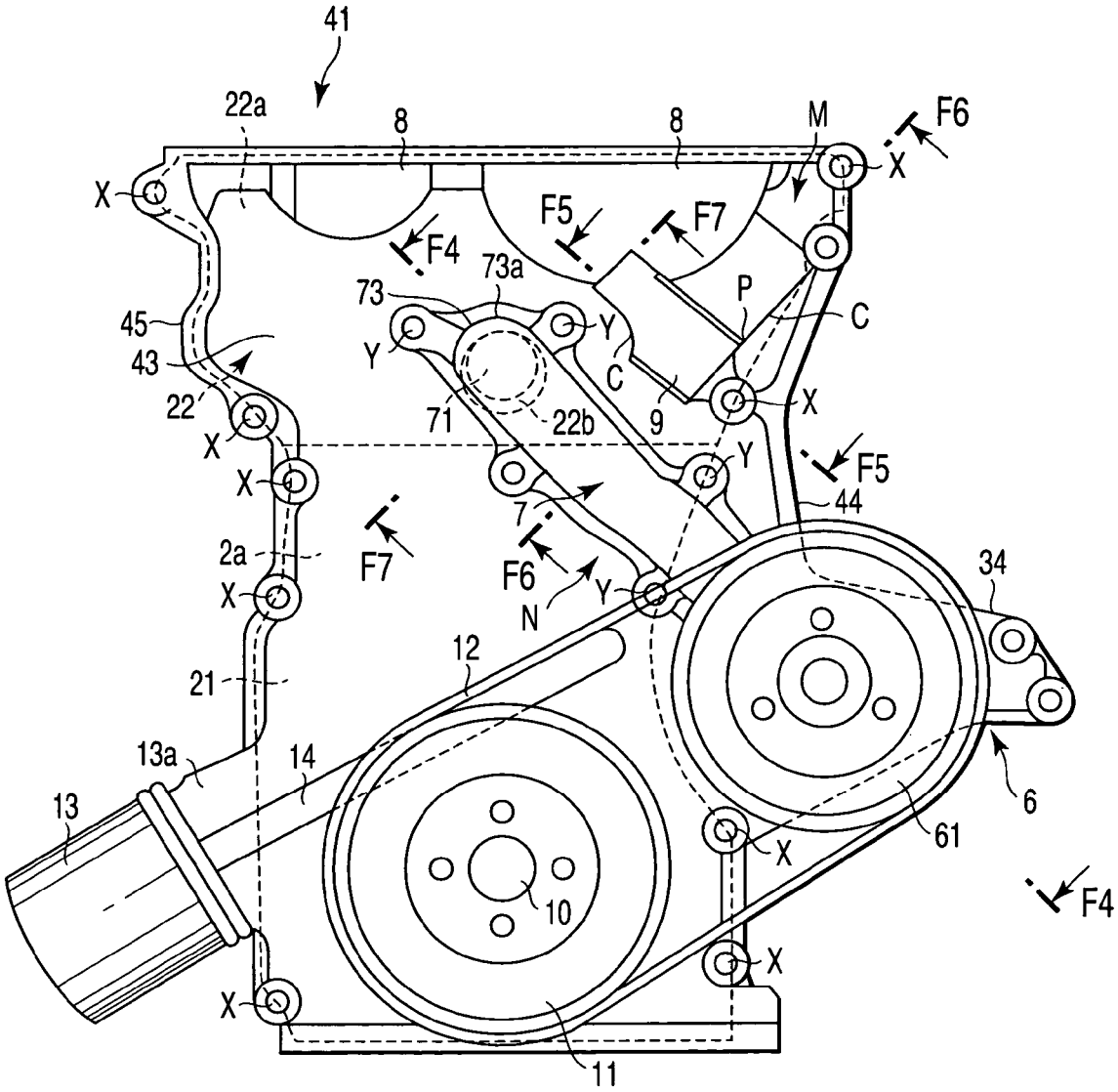
FIG. 3 is a front view of the lower chain case shown in FIG. 1.
Figure 5:
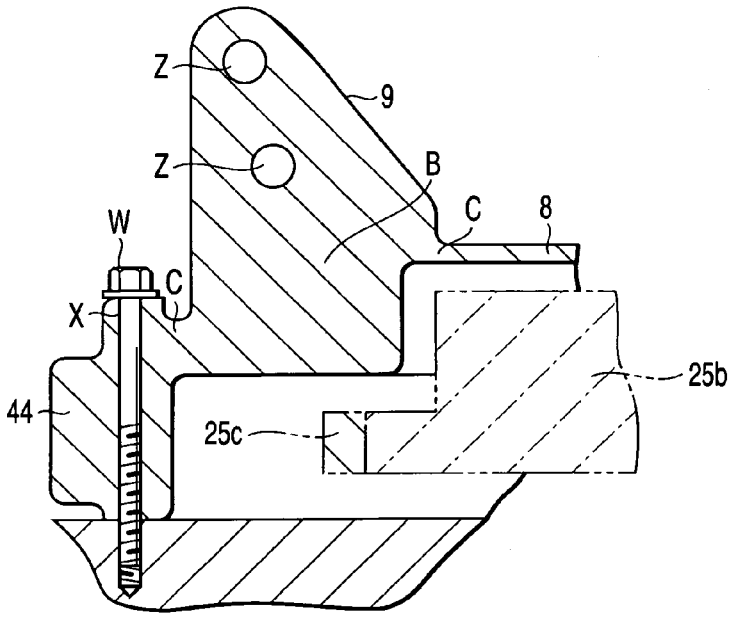
FIG. 5 is a sectional view of the lower chain case taken along line F5—F5 of FIG. 3.

As shown in FIGS. 3 and 5, a plurality of bolt holes X are formed in the left-hand edge of the lower front wall 43 of the lower chain case 41, ranging along the lower left-hand wall 44. Likewise, bolt holes X are formed in the right-hand edge of the lower front wall 43, ranging along the lower right-hand wall 45.

As shown in FIG. 1, the upper chain case 42 has an upper front wall 42*a*, upper left-hand wall 42*b*, upper right-hand wall 42*c*, and top wall 42*d*. The upper chain case 42, like the lower chain case 41, is provided with a plurality of bolt holes on the left- and right-hand side edges of the upper front wall 42*a*.

The lower and upper chain cases 41 and 42 are fastened to the engine block 2 and the cylinder head cover 3 with mounting bolts W, as shown in FIG. 5. The oil pan 5 is mounted covering both the respective lower surfaces of the lower chain case 41 and the cylinder block 21, as shown in FIG. 1.

The lower chain case 41 is provided with a water pump 6, cooling water passage 7, projecting portions 8, and engine mount bracket 9. The water pump 6 is a centrifugal pump, which is provided on the side of the cylinder block 21. The rotation axis of the water pump 6 is located in the water pump mounting portion 34 so that it is situated on the left of or outside a left-hand sidewall 35 of the cylinder block 21.

A pulley coupling shaft 10 is in engagement with the front end of the crankshaft 23. A crank pulley 11 is fixedly fitted on the front end of the pulley coupling shaft 10. The rotational force of the crankshaft 23 is transmitted to a pump pulley 61 of the water pump 6 by a belt 12. The crank pulley 11 may be designed to drive an alternator, air compressor, power steering pump, etc. (not shown), along with the water pump 6, by means of the belt 12.

As shown in FIG. 4, the water pump 6 has an impeller 101, pump chamber 50, pump shaft 100, and bearing 51. The impeller 101 applies centrifugal force to the cooling water to pressurize it. The Impeller 101 is housed in the pump chamber 50. The pump shaft 100 serves as rotation axis for the impeller 101. The bearing 51 supports the central part of the shaft 100.

The pump chamber 50 is formed in the water pump mounting portion 34 of the lower chain case 41. It communicates with an inlet port 53. The inlet port 53 opens rearward behind the mounting portion 34 in the direction along the pump shaft 100. The pump chamber 50 has a discharge port 55 that opens in the radial direction of a circle around the shaft 100. The cooling water is discharged from the discharge port 55.

The cooling water passage 7 extends from the discharge port 55 in the tangential direction of the downstream side of the rotation of the impeller 101. In the present embodiment, the discharge port 55 is situated on the downstream side of the rotation of the impeller 101, with respect to a line connecting the respective centers of the pump shaft 100 and the cooling water inlet 22*b*. The bearing 51 is fitted in a bearing housing 59. The bearing housing 59 is formed at an end portion of a passage forming member 73 on the side of the water pump mounting portion 34.

The impeller 101 is fixed on one end of the pump shaft 100 that extends from the bearing 51 toward the pump chamber 50. The pump pulley 61 is mounted on the other end of the pump shaft 100 that projects forward from the bearing housing 59. A seal member 60 is provided between the pump chamber 50 and the bearing housing 59. The seal member 60 prevents the cooling water in the chamber 50 from leaking out into the housing 59.

A cooling water inlet passage 62 is connected to the inlet port 53. The cooling water inlet passage 62 extends along axis of the crankshaft 23. The cooling water inlet passage 62 is a pipe member, for example. The inlet passage 62 guides the cooling water into the water pump 6. Thus, the pump shaft 100 is located outside the left-hand sidewall 35 of the cylinder block 21. Likewise, the passage 62 is located outside the left-hand sidewall 35 of the cylinder block 21, as shown in FIG. 2.

The cooling water passage 7 extends along the lower front wall 43 from the discharge port 55 of the water pump 6 to the cooling water inlet 22*b*, and the cooling water flows through the passage 7. In the present embodiment, the engine 1 is subjected to cylinder head pre-cooling.

As shown in FIG. 4, the cooling water passage 7 is formed on the region from pump chamber 50 to the cooling water inlet 22*b*. The cooling water passage 7 is composed of first and second components 64 and 65. The first component 64 is formed on the lower front wall 43 of the lower chain case 41. The second component 65 is formed on the side of the passage forming member 73. The passage forming member 73 is attached to the lower front wall 43 so as to cover the first component 64, thereby forming the passage forming portion according to the present invention.

Figure 6:
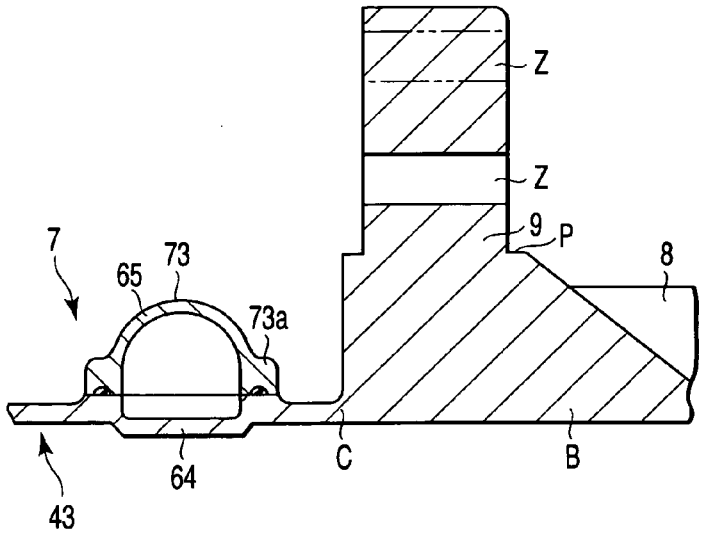
FIG. 6 is a sectional view of the lower chain case taken along line F6—F6 of FIG. 3.

As shown in FIG. 6, the first component 64 is in the form of a groove that opens forward, extending from the pump chamber 50 to a position corresponding to the cooling water inlet 22*b*. As shown in FIG. 4, the depth of the groove of the first component 64 is gradually reduced, along a direction T in which the cooling water from the discharge port 55 of the pump chamber 50 flows, to the position where the groove overlaps the front part of the engine block 2.

The second component 65 is in the form of a groove that opens rearward. The depth of the groove of the second component 65 gradually increased, along the direction T in which the cooling water from the discharge port 55 of the pump chamber 50 flows, to the position where the groove overlaps the front part of the engine block 2.

In the present embodiment, as shown in FIG. 4, the first and second components 64 and 65 are formed so that the flow sectional area of the cooling water passage 7 is fixed. That part of the passage 7 which is situated ahead of the engine block 2 extends parallel to the front wall 2*a* of the block 2 and reaches the passage outlet 71.

Thus, the second component 65 bulges forward. In the position ahead of the engine block 2, the flow sectional area of the cooling water passage 7 is wider on the side of the second component 65 than on the side of the first component 64. Thus, the second component 65 on the side of the passage forming member 73 forms the major part of the cooling water passage 7.

Figure 7:
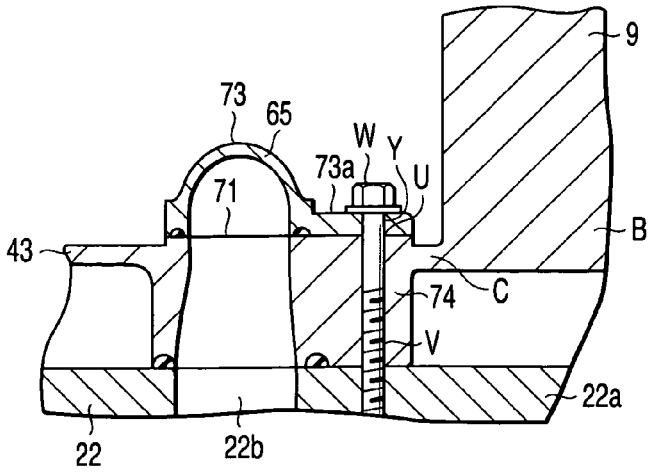
FIG. 7 is a sectional view of the lower chain case taken along line F7—F7 of FIG. 3.

As shown in FIG. 3, the passage forming member 73 has a flange 73*a* that extends along the lower front wall 43. The flange 73*a* has bolt holes Y. In FIG. 7, a rear end U of the some bolt holes Y are situated ahead of an edge portion 74 of the passage outlet 71 that reaches the cylinder head 22.

The edge portion 74 of the passage outlet 71 is provided with a through hole V that communicates with the bolt holes Y and reaches the engine block 2. Thus, the passage forming member 73 is fixed to the lower front wall 43 and the cylinder head 22 with mounting bolts W.

The location of the bolt holes Y is not limited to the positions ahead of the edge portion 74 of the passage outlet 71. For example, the bolt holes Y may be located ahead of positions corresponding to stems that extend from the lower front wall 43 to the engine block 2. The stems do not interfere the power transmission system 25. In this case, the stems are provided with the through hole V.

As shown in FIGS. 1, 3 and 5, the projecting portions 8 are formed on the parts of the lower front wall 43. The projecting portions 8 face the camshaft timing sprockets 25*b*. The projecting portion 8 bulge forward. The sprockets 25*b* are housed inside the projecting portions 8, individually.

As shown in FIGS. 1 and 3, the engine mount bracket 9 is formed in a region M on the front face of the lower front wall 43. The region M is situated near and surrounded by the cooling water passage 7, projecting portions 8, and bolt holes X and Y. The engine mount bracket 9 is formed integrally with the lower front wall 43. The bracket 9 is a solid structure that is formed integrally with the lower front wall 43 by sand casting, for example. A part of the bracket 9 bites one of the projecting portions 8.

The engine mount bracket 9 extends obliquely downward toward the lower left-hand wall 44 along the lower front wall 43. As shown in FIGS. 1 and 6, the bracket 9 extends forward and downward to a position P from the upper-left part of the wall 43. Further, the bracket 9 forwardly extends substantially at perpendicular angles to wall 43 from the position P. The engine mount bracket 9 has a plurality of tapped holes Z. For better view of the bolt holes X and Y, the mounting bolts W are not shown in FIG. 3.

In the engine 1 constructed in this manner, the engine mount bracket 9 is formed near the cooling water passage 7. The cooling water passage 7 bulges forward. More specifically, the sectional area of a basal part B (including a region near a boundary portion C between the lower front wall 43 and the bracket 9) of the bracket 9 that serves for the stiffness of the bracket is larger than that of the wall 43. Thus, the passage 7 functions as a reinforcement rib, so that the stiffness of the basal part B of the engine mount bracket 9 is improved. Thus, the stiffness of the basal part of the engine mount bracket secured sufficient.

If the lower chain case 41 is formed by sand casting, for example, a separate reinforcement rib need not be provided to secure the stiffness of the basal part B of the engine mount bracket 9. Therefore, the shape of a casting die for the lower chain case 41 is so simple that casting faults are lessened. Accordingly, the lower chain case 41 can be manufactured with improved efficiency and reduced in weight. Thus, the weight of the engine 1 can be reduced. Since the engine mount bracket 9 is not provided with the cooling water passage 7 inside, moreover, its shape can be simplified. In other words, the shape of the lower chain case 41 can be simplified.

The cooling water passage 7 is formed extending along the lower front wall 43 from the side of the cylinder block 21 to the side of the cylinder head 22. Thus, the passage 7, which has the effect of a reinforcement rib, is located covering a wide range over the chain case 4, so that the stiffness of the case 4 is improved. Besides, the stiffness of the basal part B of the engine mount bracket 9 is improved further. In this case, the passage 7 has a flow sectional area large enough to allow the cooling water discharged from the water pump 6 to flow through it. This sectional area is larger than the flow sectional area of an oil passage 14, which will be mentioned later. It is more effective, therefore, to form the bracket 9 near the cooling water passage 7.

A part of the engine mount bracket 9 bites the projecting portion 8. Since the projecting portion 8 bulges forward, the sectional area that serves for the stiffness of the basal part B of the bracket 9 is large. More specifically, the projecting portion 8 functions as a reinforcement rib, so that the basal part B of the bracket 9 is further improved in stiffness. Furthermore, the projecting portion 8 functions also as a reinforcement rib for the bracket 9. Thus, the stiffness of the bracket 9 is improved additionally.

The engine mount bracket 9 is formed near the bolt holes X and Y. The bolt holes X and Y are formed within the thickness of the lower left-hand wall 44, which extends to the engine block 2, and the thickness of the edge portion 74. Thus, the lower left-hand wall 44 and the edge portion 74 serve as reinforcement ribs, so that the stiffness of the basal part B of the bracket 9 is improved further.

The cooling water passage 7 is composed of the two components, the first component 64 on the lower front wall 43 of the lower chain case 41 and the second component 65 on the passage forming member 73. With this arrangement, the lower chain case 41 can be divided into simple shapes. Thus, the lower front wall 43 and the passage forming member 73 can be fabricated with ease.

The shape of the casting die can be made particularly simple in the case where the lower chain case 41 and the passage forming member 73 are molded integrally with each other by casting. Therefore, casting faults are lessened, and the manufacturability is improved. Further, the dimensional accuracies of the case 41 and the member 73 are also improved.

The lower chain case 41 is provided with the water pump mounting portion 34, and the pump shaft 100 of the water pump 6 is located in the mounting portion 34. Therefore, the pump 6 can be situated rearward. Thus, the size of the engine 1 can be reduced with respect to the direction along the rotation axis of the crankshaft 23.

The inlet port 53 of the water pump 6 opens rearward. Therefore, the cooling water inlet passage 62 that guides the cooling water into the inlet port 53 of the pump 6 need not extend in front of the engine block 2. Thus, the engine size can be reduced with respect to the direction along the rotation axis of the crankshaft 23.

The cooling water passage 7 is defined between the first component 64 on the lower chain case 41 and the second component 65 of the passage forming member 73. The passage forming member 73 bulges forward. Accordingly, the effective sectional area of the lower front wall 43 of the case 41 that serves for the bending stiffness can be increased without thickening the lower front wall 43 of the case 41 or the passage forming member 73 or separately providing reinforcement ribs. Thus, the first and second components 64 and 65 that constitute the cooling water passage 7 function as reinforcing members, so that the stiffness of the lower chain case 41 can be enhanced.

The water pump 6 is located relatively close to the cylinder block 21, and the cooling water inlet 22*b* is formed in the cylinder head 22. Thus, the cooling water passage 7 is formed ranging from the cylinder block 21 side to the cylinder head 22 side. In consequence, the passage 7 can effectively serve as a reinforcing member for the lower chain case 41.

The bearing housing 59 of the water pump 6 and the second component 65 are molded integrally with each other to form the passage forming member 73. Therefore, the number of essential components of the lower chain case 41 is reduced, and leak paths of the cooling water lessen.

In the present embodiment, the water pump mounting portion 34 in which the water pump 6 is located projects on the left-hand side of the lower chain case 41 lest the inlet port 53 of the pump 6 overlap the engine block 2 in the longitudinal direction. Alternatively, however, the mounting portion 34 may be formed projecting in a position such that the inlet port 53 of the pump 6 never overlaps the engine block 2 in the longitudinal direction, e.g., on the right-hand side.

As shown in FIG. 1, the lower front wall 43 is provided with an oil filter 13 and the oil passage 14. The filter 13 is attached to a filter bracket 13*a*. The bracket 13*a* is integral with the lower chain case 41.

The oil passage 14 is integral with the lower front wall 43. Like the cooling water passage 7, the oil passage 14 bulges forward. The passage 14 communicates with the oil filter 13 and the engine block 2 so that oil can flow from the filter 13 to the block 2.

Since the cooling water passage 7 and the oil passage 14 serve as reinforcement ribs, as shown in FIGS. 1 and 3, a region N in which the passages 7 and 14 are located close to each other is highly stiff. Although the engine mount bracket 9 is formed in the region M according to the present embodiment, therefore, it may alternatively be formed in the region N.

In the present embodiment, the chain case 4 is composed of the upper and lower chain cases 42 and 41, which are independent of each other. Alternatively, however, the chain cases 42 and 41 may be formed integrally with each other.

Although a chain drive system that uses a chain and sprockets is employed as the power transmission system that links the crankshaft to the camshafts, a belt drive system may be employed instead. The belt drive type uses a toothed belt and toothed pulleys in place of a chain and sprockets, respectively. Alternatively, a gear drive system may be employed. In the gear drive system, a crankshaft and camshafts are coupled by gears.

What is claimed is:

1. A power transmission system cover for an engine, comprising:

a cover portion, formed of a single-piece material and adapted to be attached to a sidewall of the engine to cover at least a part of a power transmission system which transmits a rotating force of a crankshaft to a camshaft;

a passage forming portion defining a flow-passage in which a fluid element to be supplied to the engine flows; and an engine mount bracket, for mounting the engine to a vehicle, formed integrally with the cover portion and located near the passage forming portion, wherein the flow-passage is a cooling water passage which guides cooling water to a cooling water inlet formed in one of a cylinder block and a cylinder head of the engine.

2. The power transmission system cover for an engine according to claim 1, wherein the passage forming portion extends from a side of a cylinder block to a side of a cylinder head of the engine.

3. A power transmission system cover for an engine, comprising:

a cover portion, formed of a single-piece material and adapted to be attached to a sidewall of the engine to cover at least a part of a power transmission system which transmits a rotating force of a crankshaft to a camshaft;

a passage forming portion defining a flow-passage in which a fluid element to be supplied to the engine flows; and an engine mount bracket, for mounting the engine to a vehicle, formed integrally with the cover portion and located near the passage forming portion, wherein said cover portion has a projecting portion at which a part of the cover portion projects away from the sidewall of the engine along an axial direction of the camshaft, and wherein the engine mount bracket is formed near the projecting portion.

4. A power transmission system cover for an engine, comprising:

a cover portion, formed of a single-piece material and adapted to be attached to a sidewall of the engine to cover at least a part of a power transmission system which transmits a rotating force of a crankshaft to a camshaft;

a passage forming portion defining a flow-passage in which a fluid element to be supplied to the engine flows; and an engine mount bracket, for mounting the engine to a vehicle, formed integrally with the cover portion and located near the passage forming portion, wherein the engine mount bracket is formed near bolt holes formed in said cover portion through which mounting bolts for mounting said cover portion to the side of the cylinder block of the engine are inserted.

5. A power transmission system cover for an engine, comprising:

a cover portion, formed of a single-piece material and adapted to be attached to a sidewall of the engine to cover at least a part of a power transmission system which transmits a rotating force of a crankshaft to a camshaft;

a passage forming portion defining a flow-passage in which a fluid element to be supplied to the engine flows; and an engine mount bracket, for mounting the engine to a vehicle, formed integrally with the cover portion and located near the passage forming portion, wherein said cover portion is provided with a water pump mounting portion which projects at perpendicular angles to an axial direction of the crankshaft and in which a rotating shaft of a water pump is located.

6. The power transmission system cover for an engine according to claim 5, wherein a fluid element inlet passage extending along an axis of the crankshaft is formed in an inlet port which opens in the water pump mounting portion along the rotating shaft of the water pump.

7. The power transmission system cover for an engine according to claim 5, wherein the water pump is located on a side of a cylinder block of the engine, and a cooling water inlet is located on a side of a cylinder head of the engine.

8. The power transmission system cover for an engine according to claim 5, wherein a housing which holds a bearing of the rotating shaft of the water pump is formed integrally with the passage forming portion.

9. A power transmission system cover for an engine, comprising:

a cover portion, formed of a single-piece material and adapted to be attached to a sidewall of the engine to cover at least a part of a power transmission system which transmits a rotating force of a crankshaft to a camshaft;

a passage forming portion defining a flow-passage in which a fluid element to be supplied to the engine flows; and an engine mount bracket, for mounting the engine to a vehicle, formed integrally with the cover portion and located near the passage forming portion, wherein said cover portion includes a wall portion that extends from a periphery of said cover portion toward the sidewall of the engine.

10. A power transmission system cover for an engine, comprising:

a cover portion, formed of a single-piece material and adapted to be attached to a sidewall of the engine to cover at least a part of a power transmission system which transmits a rotating force of a crankshaft to a camshaft;

a passage forming portion defining a flow-passage in which a fluid element to be supplied to the engine flows;

an engine mount bracket, for mounting the engine to a vehicle, formed integrally with the cover portion and located near the passage forming portion; and an upper cover portion adapted to be attached to a sidewall of a cylinder head cover of the engine.

* * * * *